US007191911B2

(12) United States Patent
O'Neill

(10) Patent No.: US 7,191,911 B2
(45) Date of Patent: Mar. 20, 2007

(54) RESEALABLE TAB FOR A DRINKING CUP

(76) Inventor: Catherine O'Neill, 601 E. Sola St., Santa Barbara, CA (US) 93103

( * ) Notice: Subject to any disclaimer, the term of this patent is extended or adjusted under 35 U.S.C. 154(b) by 0 days.

(21) Appl. No.: 11/067,870

(22) Filed: Feb. 28, 2005

(65) Prior Publication Data

US 2005/0139597 A1 Jun. 30, 2005

Related U.S. Application Data

(63) Continuation of application No. 09/927,606, filed on Aug. 9, 2001, now abandoned.

(60) Provisional application No. 60/223,341, filed on Aug. 11, 2000.

(51) Int. Cl.
*B65D 17/34* (2006.01)
*B65D 65/14* (2006.01)
*A47G 19/22* (2006.01)

(52) U.S. Cl. ..... 220/254.1; 220/359.2; 220/713; 229/404; 229/906.1

(58) Field of Classification Search ..... 220/254.1, 220/359.1, 359.2, 359.3, 359.4, 703, 711, 220/713, 260, 270, 232; 229/404, 400, 906.1
See application file for complete search history.

(56) References Cited

U.S. PATENT DOCUMENTS 3,312,368 A * 4/1967 Reynolds et al. ..... 220/359.2
3,338,462 A * 8/1967 Reynolds et al. ..... 220/791
3,389,827 A * 6/1968 Abere et al. ..... 220/359.1
3,935,960 A * 2/1976 Cornell ..... 220/260
4,318,490 A * 3/1982 Schneider ..... 215/232
4,514,248 A * 4/1985 Cummings ..... 156/268
4,853,267 A * 8/1989 Lu et al. ..... 428/35.7
5,599,602 A * 2/1997 Leonard et al. ..... 428/56
D417,845 S * 12/1999 Sadlier et al. ..... D9/447
6,578,723 B1 * 6/2003 Tyner ..... 215/232
7,111,749 B1 * 9/2006 Akers ..... 220/359.2

* cited by examiner

*Primary Examiner*—Anthony D. Stashick
*Assistant Examiner*—James Smalley
(74) *Attorney, Agent, or Firm*—Mark Rodgers

(57) ABSTRACT

A lid and resealable tab for a drinking cup is shown. The lid has an outer edge having a generally circular periphery and a top surface for defining a drinking opening having a predetermined shape and dimension. The lid includes an annular sidewall operatively connected to and extending circumferentially or axially from the lid and in a first direction relative to the top surface. An annular mounting member is formed on the sidewall lid for sealingly engaging the lip of a drinking cup. A resealable tab having a relatively thin, flexible substrate having a first surface and second surface, the substrate having a shape and dimension which is configured to cover the drinking opening with either one of the first surface and second surface is shown. The resealable tab includes a food grade adhesive. In the preferred embodiment, the adhesive is located on one of the first surface and second surface to enable one of the first surface and second surface to be located over the drinking opening and to have the adhesive form a sealing relationship between the top surface and one of the first and second second surface.

12 Claims, 6 Drawing Sheets

RESEALABLE TAB FOR A DRINKING CUP

CROSS-REFERENCES TO RELATED APPLICATIONS

This application is a continuation, under Title 35, CFR 1.53(b,) of application Ser. No.: 09/927,606 filed Aug. 9, 2001, now abandonded, which in turn claims the benefit, under Title 35, United States Code S119(e), of U.S. Provisional Patent Application Ser. No.: 60/223,341 filed Aug. 11, 2000.

STATEMENT REGARDING FEDERALLY SPONSORED RESEARCH OR DEVELOPMENT

Not Applicable

REFERENCE TO A "MICROFICHE APPENDIX" (SEE 37 CFR 1.96)

Not Applicable

BACKGROUND OF THE INVENTION

1. Field of the Invention

This invention relates to a lid and resealable tab for use on a lid for a drinking cup and more particularly relates to a lid having a top surface which defines a drinking opening having a predetermined shape and dimension and a resealable tab having a relatively thin, flexible substrate having a first surface and second surface having a food grade adhesive located between the top surface and one of the first surface and second surface, wherein the substrate has a shape and dimension which is adapted to removeably cover the drinking opening thereby preventing spillage.

In the preferred embodiment, the substrate has a food grade adhesive coated on one of the tab surfaces to enable the substrate to be located over the drinking opening and to have the adhesive form a sealing relationship between that portion of the top surface surrounding and defining the drinking opening and the surface of the substrate positioned towards or facing the drinking opening. The spacing between the top surface and tab is determined by the thickness of the adhesive layer which must have a minimum thickness to withstand fluid forces from the fluid being directed against the resealable tab.

2. Description of the Prior Art

It is known in the prior art to have a lid for a drinking cup which has a drinking opening. U.S. Pat. No. 5,692,616 discloses a sanitary drink cup lid which includes a drinking cup lid and a protective covering enclosing the drinking cup lid. The protective covering is peeled, by the user, from the drinking cup lid exposing the drinking opening prior to use. A drinking opening is provided in the cover portion adjacent to the lip portion. The protective covering enclosing the drinking Cup lid comprises a top protective sheet and a bottom protective sheet which are joined together beyond the periphery of the drinking cup lid as well as through the drinking opening. When the protective covering is peeled from the drinking cup, the top protective sheet, which is joined to an interior section of the bottom protective sheet, pulls the bottom protective sheet through the drink opening during removal.

U.S. Pat. No. 4,953,743 discloses a lid for use on a drinking cup having a central horizontal cover portion which has a vent means. The central cover portion of the lid has a plurality of downwardly depending spaced apart channel portion provided therein forming wave dampening baffles to dampen the waves of splashing of the contents of the cup to minimize accidental splash actuated-spillage of the contents of the cup through the vent opening.

U.S. Pat. No. 4,753,365 discloses a lid for a drinking cup having a removal tab to permit removal thereof by the fingers of a user engaging a vertical portion of the lid and separation the same from the lid exposing a drinking opening in a predetermined location.

U.S. Pat. No. 4,589,569 discloses a lid for a drinking cup wherein a top wall has a drinking opening formed therein the top wall of the lid has a recess formed in it adjacent to a drinking opening to accommodate the upper lid to accommodate the upper lip of the user.

U.S. Pat. No. 4,438,865 discloses a lid for a drinking cup comprising a circular-like body having a downturned channel section formed continuously about the periphery for engagement at the rim of a drinking cup. The lid is optionally usable in one mode in which a straw is inserted through a straw aperture, while the straw itself is supported by the inner end of the drink tab and in another mode after the tab is removed to provide a larger reinforced drink opening including part of the straw aperture.

U.S. Pat. No. 5,911,331 discloses a plastic dome for a drinking cup which has the capability of functioning as a complete closure lid as a cup and as a drink through lid employing a recloseable-open lid segment which is used for completely closing the lid.

U.S. Des. Pat. No. 417,845 discloses a drinking lid having a raised annular shaped ridge formed around the periphery of the lid wherein the raised annular shaped ridge forms an elongated shaped slot which functions as a drinking opening for the drinking lid.

In the known prior art lids, a user transports a drinking cup containing liquid or fluid, e.g. hot coffee, wherein the prior art lid has an uncovered or open drinking opening such that the liquid or fluid can splash out of, spout out of or otherwise be propelled out of the drinking opening.

In the known prior art lids which have removable tabs, once the user removes the tab the liquid or fluid contained within the drinking cup can splash out of, spout out of or otherwise be propelled out of the drinking opening.

In the sanitary drinking cup lid disclosed in U.S. Pat. No. 5,692,616, a protective sheet is formed over the entire lid and is joined to an inner section of a bottom protective sheet and the intersection of the bottom portion is pulled through the drinking opening during the user peeling away the protective sheet. Once the drinking opening has been exposed, the liquid or fluid in the drinking cup can splash out of, spout out of or otherwise be propelled out of the drinking opening. Further, the drinking opening cannot be resealed.

None of the known prior art teaches the use of resealable tab having a relatively thin, flexible substrate and a food grade adhesive for removable sealing the drinking opening in a lid for a drinking cup.

BRIEF SUMMARY OF THE INVENTION

The present invention discloses and teaches a new, novel and unique resealable tab adapted to seal a drinking opening on a lid for a drinking cup.

The know prior art, including the above referenced United States Patents, do not disclose, suggest or teach a lid and resealable tab for a drinking cup having a preformed drinking opening, a resealable tab adapted to seal a drinking opening in a lid for a drinking cup or a combination of a drinking cup, a lid and a resealable tab having a relatively thin flexible substrate adapted to cooperate with a food grade adhesive to removebly seal a drinking opening.

Therefore, one of the advantages of the present invention is that a lid for a drinking cup having a drinking opening formed in the lid can have the drinking opening removeably closed with a resealable tab using the teachings of the present invention. The resealable tab prevents spillage, spouting or otherwise propelling of fluid through a drinking opening.

Another advantage of the present invention is that the resealable tab can be in the form of a relatively thin, flexible substrate having first surface and second surface wherein the substrate has a predetermined shape and dimension and which is adapted to cover the drinking opening with either one of the first surface and second surface.

Another advantage of the present invention is that the resealable tab can include a food grade adhesive located between one of the surfaces of a relatively thin, flexible substrate and the top surface defining a drinking opening.

Another advantage of the present invention is that the food grade adhesive can be affixed to, preferably coated on, either of the first surface and second surface of a thin, flexible substrate.

Another advantage of the present invention is that the food grade adhesive can be coated around the periphery of the drinking opening and a relatively thin, flexible substrate can be affixed to the adhesive and enclosing the drinking opening to form a resealable tab.

Another advantage of the present invention is that the relatively thin, flexible substrate can have a food grade adhesive coated thereon such that the substrate can be positioned over the drinking opening exposing a portion of the food grade adhesive to the drinking opening.

Another advantage of the present invention is that the resealable tab can be removed from the drink opening, placed at a temporary location on the lid surface for storage while the user drinks from the drinking opening and the tab can then be replaced over the drinking opening until the user desires to drink again from the drinking opening.

Other features and advantages will appear from the following description in which the preferred embodiments have been set for the in detail in conjunction with the accompanying drawings.

DETAILED DESCRIPTION OF THE INVENTION

In the embodiments described herein in Figures the common elements are identified with the same numbers.

Figure 1A:
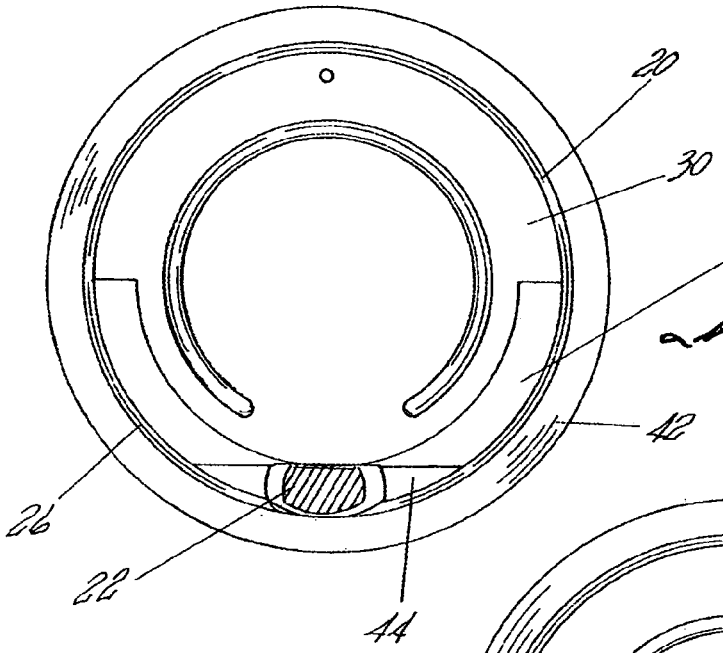
FIGS. 1(A), 1(B) and 1(C) are top plan views of lids for a drinking cup having a resealable tab of different designs affixed to and sealing a drinking opening.
Figure 1B:
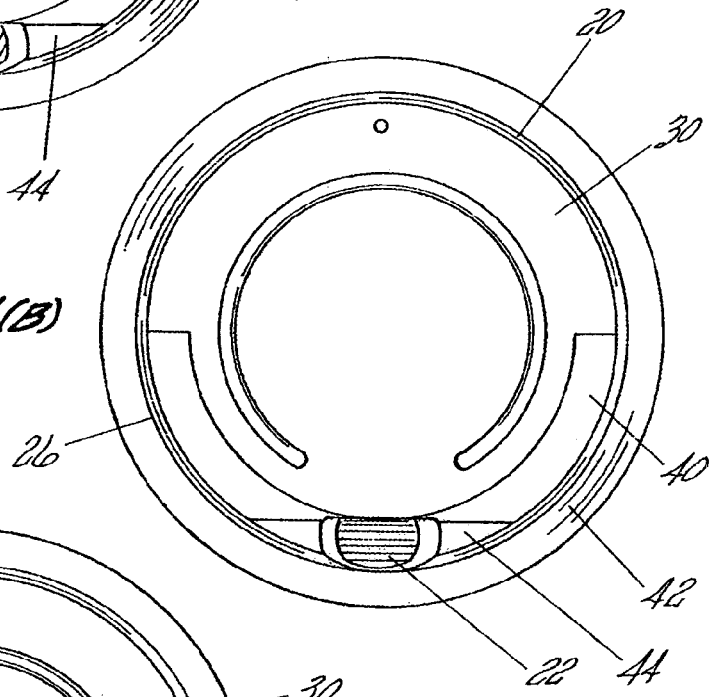
Figure 1C:
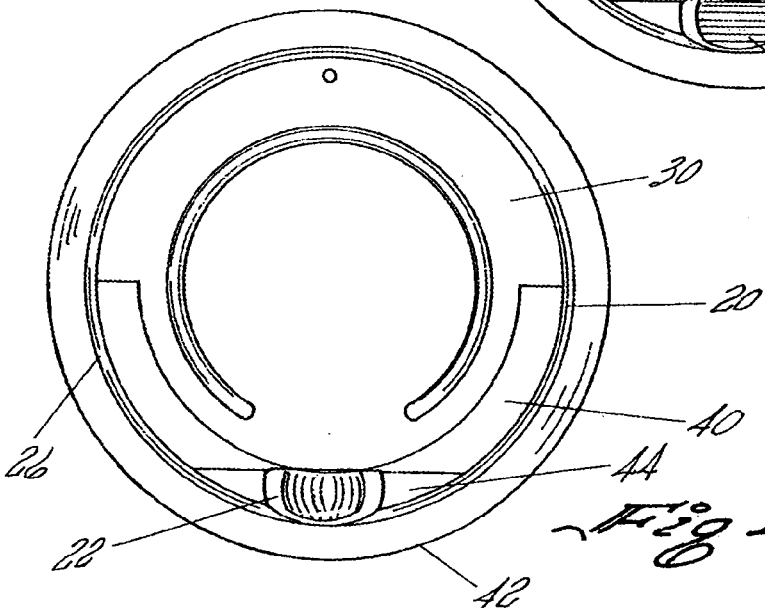

FIGS. 1(A), 1(B) and 1(C) show a lid 20 and resealable tab 22 for a drinking cup. Each tab may be of a different shape or may be the same shape but of different size. Advertising indicia may be included on or affixed to the tab 22. The lid 20 has a outer edge 26 having a generally circular periphery and a top surface 30 for defining a drinking opening, visible as element 32 in FIG. 3, and having a predetermined shape and dimension.

Figure 2A:
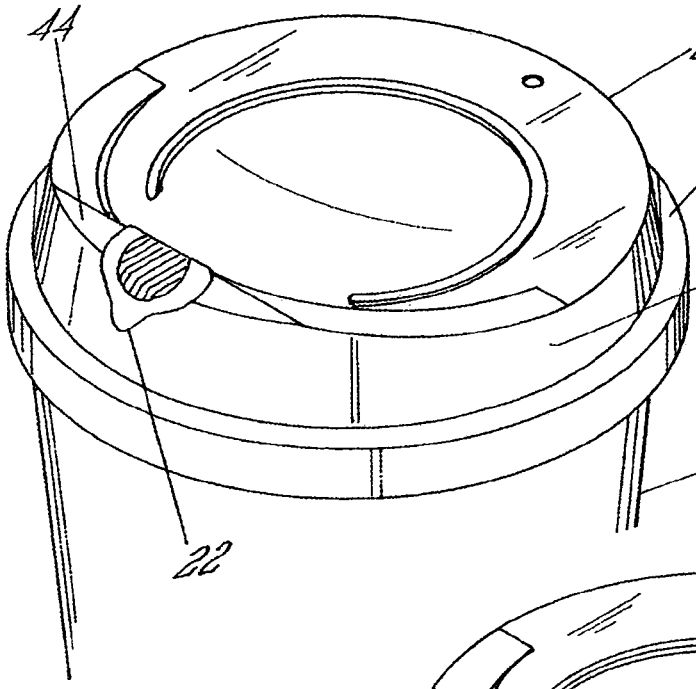
FIGS. 2(A), 2(B) and 2(C) are top, front and left side perspective views of the embodiments of FIGS. 1(A), 1(B) and 1(C), respectively showing the seal in a sealed position, a partially removed position and fully open position respectively.
Figure 2B:
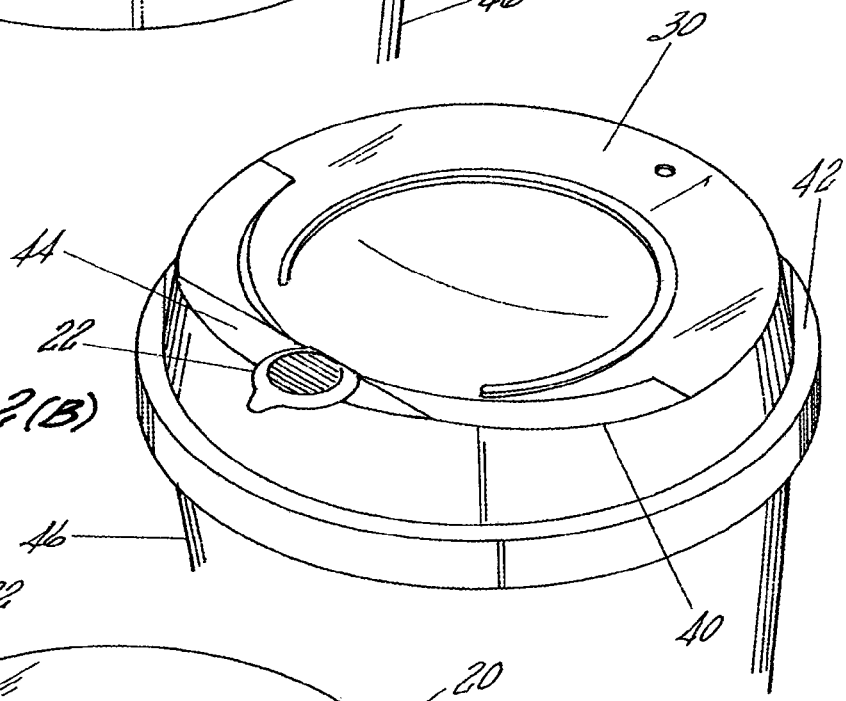
Figure 2C:
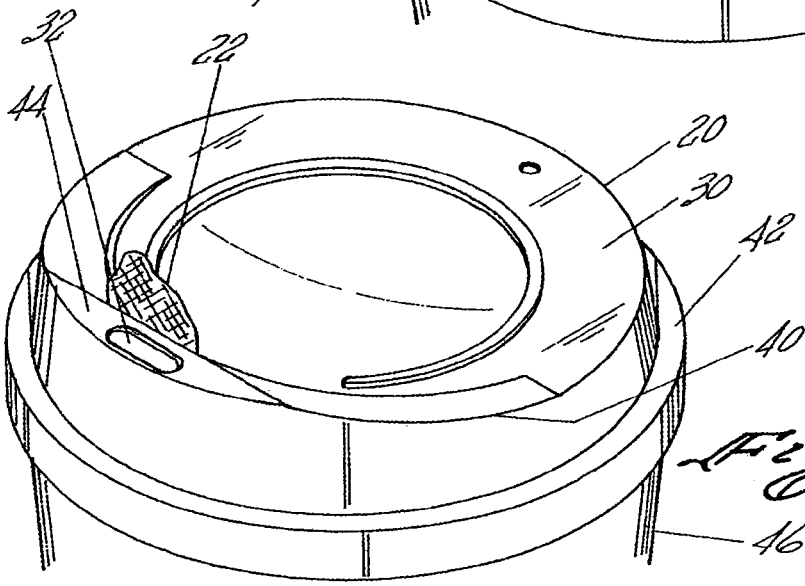

An annular sidewall 40 is operatively connected to and extends circumferentially or axially from the outer edge 26 and extends in a first direction relative to the top surface. In FIGS. 1(A), 1(B) and 1(C), sidewall 40 extends away from the top surface 30. Sidewall 40 extends higher around about halfway of the periphery of the lid 20, An annular mounting member 42 is formed on the lid 20 and functions to sealingly engaging the lip of a drinking cup 46. In FIGS. 2(A), 2(B0 and 2(C), the annular mounting member 42 extends circumferentially or axially around the edge of the cup 46. The resealable tab 22 folds over the top surface 44 defined by the annular sidewall 40 to insure a sealing relationship.

The resealable tab 22 has a relatively thin, flexible substrate having a first surface and second surface as shown in greater detail in FIGS. 6(A), 6(B), 6(C), 7(A), 7(B) and 7(C). The substrate has a predetermined shape and dimension which is adapted to cover the drinking opening 32 with either one of of the first and second surfaces.

In FIGS. 1(A), 1(B), 1(C), 2(A), 2(B), 2(C), 3(A), 3(B) and 3(C), the annular sidewall 40 extends in first direction which is away from the top surface 30 defining the drinking opening 32.

Figure 3A:
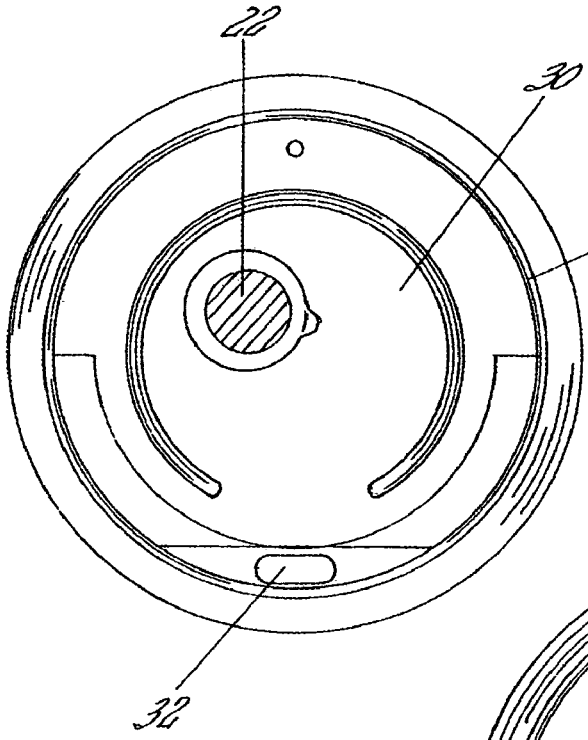
FIGS. 3(A), 3(B) and 3(C) are top plan views of the embodiments of FIGS. 1(A), 1(B) and 1(C), respectively, wherein the resealable tabs are removed from a sealing relationship with the top surface and exposing the drinking opening formed in a lid and the removed seal is temporarily stored by being placed in the recessed central portion of the lid.
Figure 3B:
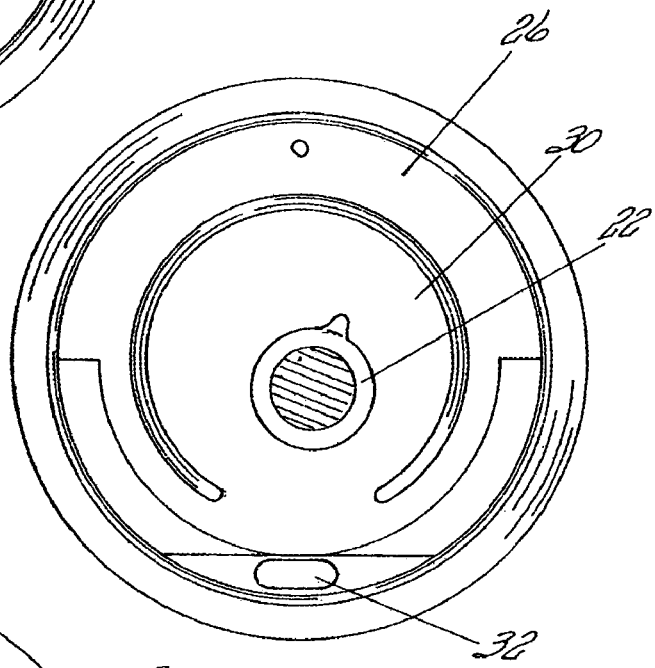
Figure 3C:
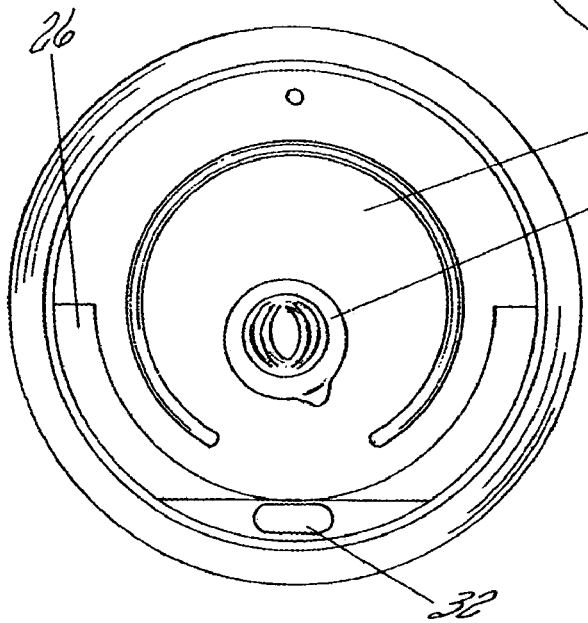

In FIGS. 3(A), 3(B) and 3(C) depicts the tab 22 as being removed from the opening 32 and being temporarily stored on top surface 30.

Figure 4:
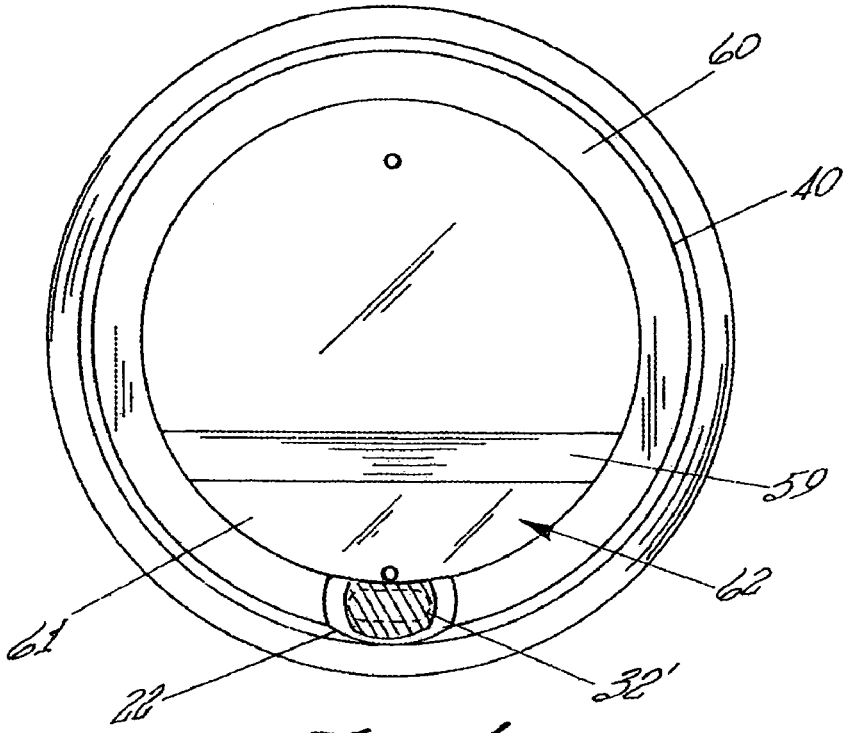
FIG. 4 is a top plan view of another embodiment of a lid having a partially recessed section for receiving the lip of a user and wherein the sidewalls are formed away from the drinking opening and the drinking opening is located in the outer edge and is sealed with a resealable tab having a relatively thin, flexible substrate having a food grade adhesive coated thereon.

In FIG. 4, the annular sidewall 40 on the outside extends in a first direction which is away from top surface 30 defining the drinking opening shown by dashed opening 32'. The partially recessed area shown by arrow 62 communicates with a sloped surface 59 which extends in a direction which is towards the recessed area 62 and top surface 30.

Figure 5:
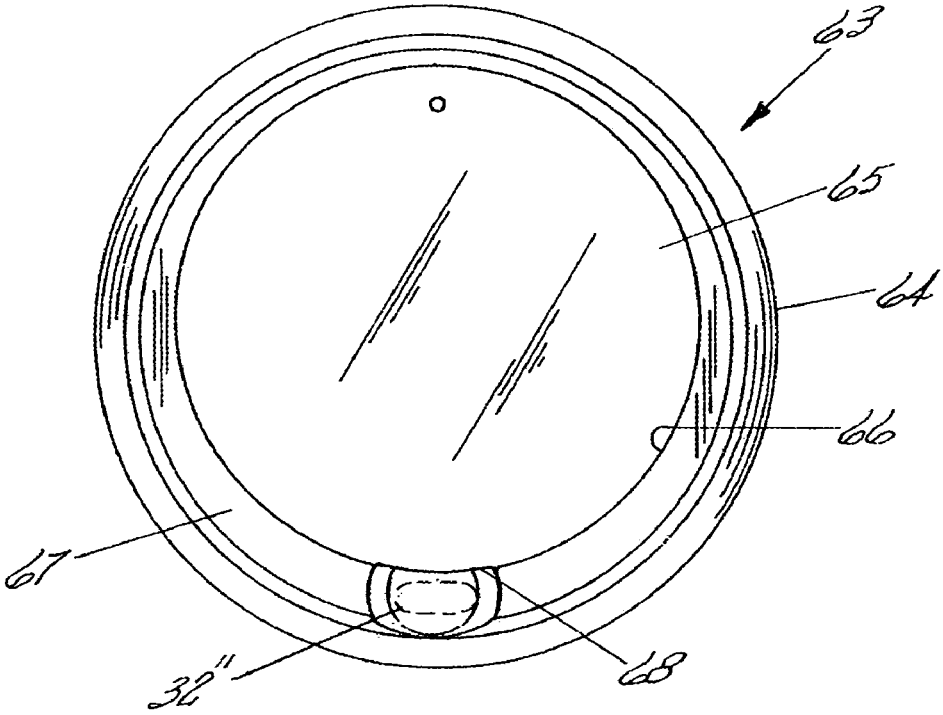
FIG. 5 is a top plan view of still another embodiment of a lid having a generally circular shaped and having a substantial portion of the center lid surface recessed for receiving the lid of a user wherein the first sidewall and the drinking opening is located on a top surface of the sidewall and the drinking opening is sealed with a resealable tab having a relatively thin, flexible substrate having a food grade adhesive coated thereon.

In FIG. 5 the embodiment of the lid 63 is generally circular shaped and has a raised outer annular ring 64 having sidewalls 66. The center portion adjacent the sidewalls 66 forms a recessed area within the central lid surface and is recessed over substantially the entire surface as shown by recessed area 65. The recessed area 65 is adapted to receive the lip of a user. A resealable tab 68 is located across the drinking opening shown by dashed opening 32" formed in the top surface 67 of the annular ring 64. The drinking opening 32" is located under the resealable tab 68.

Figure 6A:
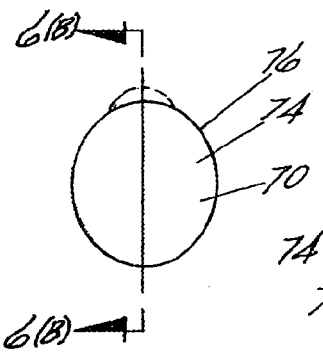
FIG. 6(A) is a pictorial representation of a circular shaped resealable tab for sealing the drinking opening in a lid having a food grade adhesive coated on one surface thereof.
Figure 6B:
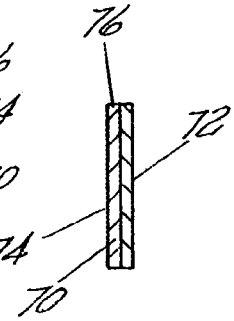
FIG. 6(B) is a pictorial representation of a circular shaped resealable tab of FIG. 6(A) illustrating a substrate defining the resealable tab and having a food grade adhesive coated on one surface thereof.
Figure 6C:
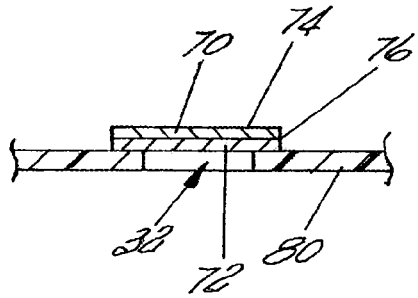
FIG. 6(C) is a pictorial representation of a circular shaped resealable tab for sealing the drinking opening in a lid having a food grade adhesive coated thereon illustrated in FIG. 6(A) and located over an opening formed in a lid to seal the same exposing the remaining portion of the food grade adheasive over the drinking opening.

In FIGS. 6(A), 6(B) and 6(C), a resealable tab 70 for a drinking cup lid surface 80 has a food grade adhesive 72 coated on one of the first surface 74 and second surface 76. The adhesive 72 forms a sealing layer having a predetermined thickness. As shown in FIG. 6(C), the one of the first surface and second surface is affixed in an opposed spaced relationship to the drinking opening 32. The spacing there between is determined by the thickness of the adhesive sealing layer. In FIG. 6(C), surface 76 has the adhesive 72 coated or formed thereon forming an adhesive sealing layer.

As shown in FIGS. 6(A), 6(B) 6(C), 7(A), 7(B) and 7(C), a food grade adhesive is located between one of the first surface and second surface and a drinking cup lid surface 80 or 100 to enable one of the first and second surfaces to be located over the drinking opening 32. The adhesive is shown as 72 in FIG. 6(C) and as 86 in FIG. 7(C) and forms a sealing relationship between that portion of the top surface 30 defining the drinking opening 32. In FIGS. 6(A), 6(B) and 6(C), the one of the first surface and second surface exposes the remaining portion of the adhesive to the drinking opening 32 located in the top surface. The spacing between 72 and drinking cup lid surface 80 is determined by the thickness of the adhesive sealing layer as depicted in FIGS. 6(C) and 9(C).

In FIG. 6(C), the drinking cup lid surface 80 is in sealing engagement with the adhesive 72 which is preferably coated on surface 76.

It is envisioned that any technique for applying the adhesive may br used in practicing this invention. This includes, without limitation, spraying, coating, vaporizing, sputtering, rolling, affixing preshaped adhesive forms around the opening on the tab surface and any other technique known to persons skilled in art.

The food grade adhesive may comprise a polyethylene composition or other food grade adhesive as is well known in the art. For example labels affixed to fruit and vegetables have food grade adhesive.

Preferably, the food grade adhesive comprises a composition which has increased adhesivity as the temperature thereof is increased above ambient temperature. Such an adhesive would provide a better sealant for hot liquids, such as hot coffee in a drinking cup.

It is envisioned that a combination for protecting the invention would comprise the following elements: (i) a drinking cup having a lip defining a top opening, and (ii) a lid having an outer edge having a generally circular periphery. In such a combination, the lid includes a top surface for defining a drinking opening having a predetermined shape and dimension and an annular shaped sidewall which is operatively connected to and which extends circumferentially or axially from the lid and in a first direction relative to the top surface. An annular mounting member is formed on the lid for sealingly engaging the lip of the drinking cup.

A resealable tab for use in the combination would have a relatively thin, flexible substrate having a first surface and second surface wherein the substrate would have a shape and dimension which is adapted to cover the drinking opening with either one of the first surface and second surface. A food grade adhesive is located between one of the first surface and second surface and the top surface to enable one of the first and second surfaces to be located over the drinking opening and to have the adhesive form a sealing relationship between that portion of the top surface defining the drinking opening and the one of the first and second surface, the spacing there between being defined by the thickness of the adhesive layer.

Thus, FIGS. 6(A), 6(B) and 6(C) covers the preferred embodiment wherein the adhesive 72 is coated on the second surface 76. The second surface 76 having the adhesive 72 located thereon is affixed to the drinking opening 32 exposing that portion of the adhesive not in sealing engagement with surface to the drinking opening 32 to fluid spouting through the sealed drinking opening 32 and into contacting the adhesive 72.

Figure 7A:
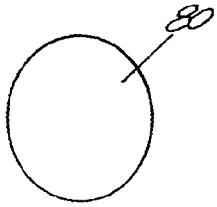
FIG. 7(A) is a pictorial representation of a circular shaped resealable tab for sealing the drinking opening in a lid without a food grade adhesive coated thereon.
Figure 7B:
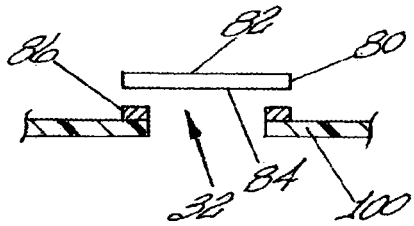
FIG. 7(B) is a pictorial representation of a circular shaped resealable tab of FIG. & (A) illustration a substrate defining the resealable tab and positioned above the drinking opening formed in the top surface of the lid wherein a food grade adhesive is formed around the periphery of the drinking opening.
Figure 7C:
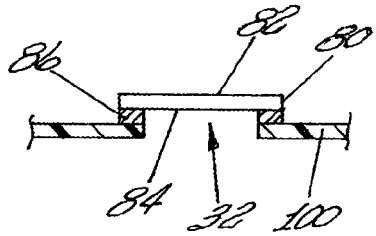
FIG. 7(C) is a pictorial representation of a circular shaped resealable tab for sealing the drinking opening in a lid as illustrated in FIG. 7(B) wherein the food grade adhesive is in sealing engagement with the circular shaped resealable tab for closing the drinking opening.

In the alternative, FIGS. 7(A), 7(B) and 7(C) cover the embodiment wherein the adhesive 86 is coated on the top surface of a drinking cup lid surface 100 and no adhesive is affixed to the resealable tab 80. One of the first surface 82 and second surface 84 is affixed to the adhesive 86 coated on that portion of the top surface of a drinking cup 100 surrounding the drinking opening 32. This embodiment reduces the amount of adhesive which would come in contact with a fluid spouting through the sealed drinking opening 32.

Figure 8:
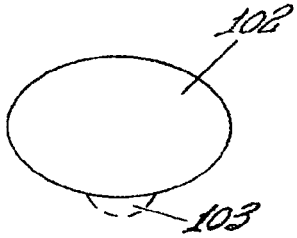
FIG. 8 is a pictorial representation of an oblong or oval shaped substrate adapted for use as a resealable tab for practicing this invention and having a protruding lifting member shown by dashed lines to facilitate removal of the tab.

In FIG. 8, the pictorial representation of an oblong shaped substrate or tab 102 is shown as having a lifting member 103. The tab 102 may be used for a drinking opening which can be either oblong or oval in shape. Such shapes of drinking openings are disclosed in the known prior art lids for drinking cups as described above. Dashed lines 103 represent a protruding lifting member to facilitate removal an/or replacement of the tab 102 on a drinking opening.

The lifting member can be formed of any predetermined shape, such as for example, a protruding lifting member or an elongated lifting member.

Figure 9:
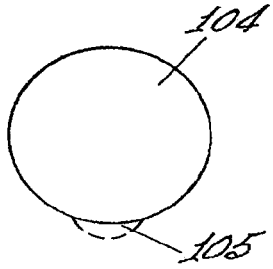
FIG. 9 is a pictorial representation of a circular shaped substrate adapted for use as a resealable tab for practicing this invention and having protruding lifting member shown by dashed lines to facilitate removal of the tab.

In FIG. 9, the pictorial representation is of a circular shaped substrate 104 adapted for use for removeably sealing a drinking opening having a dimension which is less than that of the circular shaped substrate. The dimension of the circular shaped substrate should be selected to allow sufficient overlap of the edge thereof beyond the periphery of the drinking opening. Dashed lines 105 represent a protruding lifting member to facilitate removal and/or replacement of the tab 104 on a drinking opening.

Figure 10:
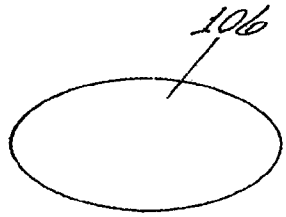
FIG. 10 is a pictorial representation of an elongated circular shaped substrate adapted for use as a resealable tab for practicing this invention.

In FIG. 10, the pictorial representation is of an elongated shaped substrate or tab 106 adapted for use as a resealable tab for practicing this invention Thus, if the shape of the tab is oblong or oval, no lifting member may be required.

Figure 11:
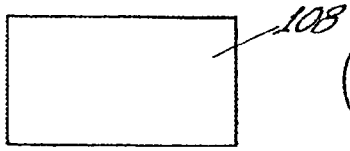
FIG. 11 is a pictorial representation of a rectangular shaped substrate adapted for use as a resealable tab for practicing this invention.

In FIG. 11, the pictorial representation is of a rectangular shaped substrate or tab 108 adapted for use as a resealable tab for practicing this invention. Tab 108 has an appropriate predetermined shape and dimension which can be sealed using a rectangular shaped resealable tab.

Figure 12:
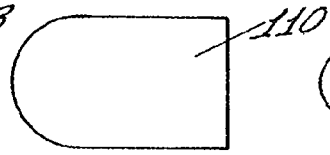
FIG. 12 is a pictorial representation of a combination an elongated circular shaped and rectangular shaped substrate adapted for use as a resealable tab for practicing this invention.

In FIG. 12, the pictorial representation is of a resealable tab 110 which is a combination of a circular shape and rectangular shape configured for use as a resealable tab for practicing this invention in a manner similar to that described above in connection with FIGS. 8 thorough 11.

Figure 13:
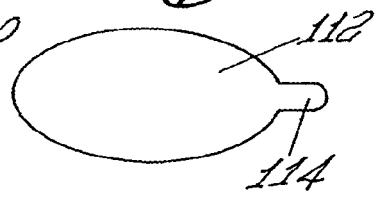
FIG. 13 is a pictorial representation of an oblong shaped substrate illustrated in FIG. 10 having a protruding lifting member adapted for use as a resealable tab for practicing this invention.

In FIG. 13, the pictorial representation is of an oblong shaped substrate or tab 112 similar to tab 106 illustrated in FIG. 10, except that 112 has a protruding lifting member 114 adapted for use as a resealable tab for practicing this invention. A user can use a user's fingers to grasp the protruding lifting member for removing the resealable seal from the drinking opening. Also, a user can utilize the protruding lifting member to reaffix the resealable tab over the drinking opening.

Figure 14:
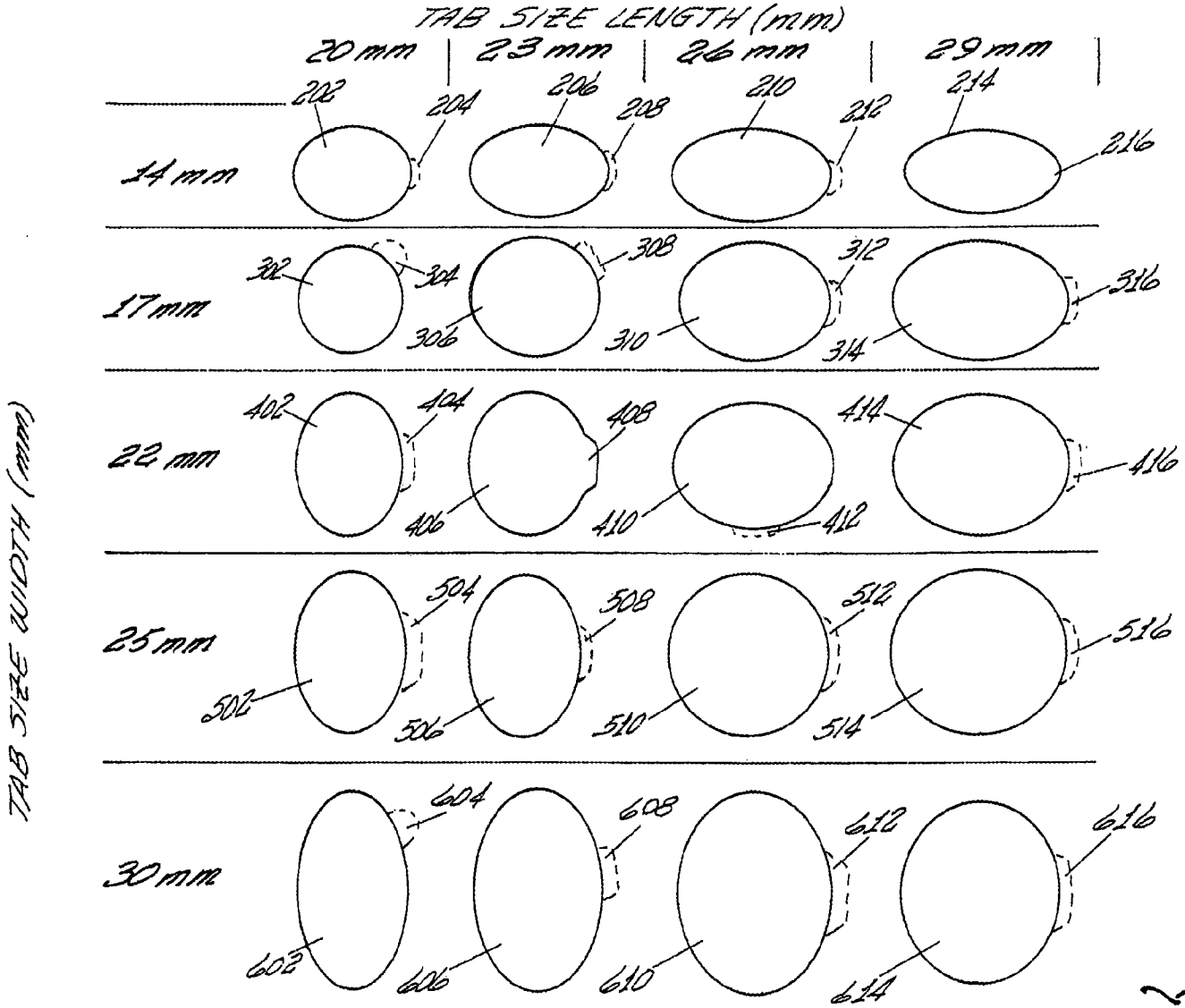
FIG. 14 is a chart illustrating various resealable tab shapes and sizes with the tab size plotted or shown as a function of tab depth wherein the tab size includes 20 mm, 23 mm, 26 mm, and 29 mm and the tab depth includes 14 mm, 17 mm 22 mm, 25 mm and 30 mm and wherein certain of the shapes of the tabs associated with the illustrated tab size and tab depth are shown together with a lifting member depicted for each tab shape.

FIG. 14 is a chart, which illustrates by shape, several examples of resealable tabs and associated lifting members for a selected number of tab sizes, in mm plotted or shown as a function of tab depth, in mm. In the chart of FIG. 14, a resealable tab having a size of 20 mm and tab depth of 14 mm is shown to have and oval shape 202 having a lifting member 204. Tab shape 206 has a lifting tab 208, a size of 23 mm and depth of 14 mm. Tab shape 210 has a tab size of 26 mm, a tab depth of 14 mm and lifting member 212. Tab shape 214 has a size of 29 mm and depth of 14 mm and a lifting member of 216. If the label depth Is held at about 14 mm and the tab size is increased, the resealable tab takes on a more generally oval or oblong shape.

Resealable tab shapes 302 through 314 are illustrated for tab sizes 20 mm, 23 mm, 26 mm and 29 mm. Each of the tab shapes 302, 306, 310 and 314 have lifting members 304, 308, 213 and 316 respectively.

Tab shapes 402, 406, 410 and 414 are illustrated using the same tab depth of 22 mm, and vary in tab sizes of 20 mm, 23 mm, 26 mm and 29 mm respectively. Each tab shapes 402, 406, 410 and 414 have lifting members 404, 408, 412, and 416 respectively. Lifting member 408 is depicted as being formed of a selected shape in the tab 406. Lifting members 404, 408, 412 and 416 are shown by dashed lines and can be formed in any appropriate shape.

Resealable tab shapes having a 25 mm depth and tab size of 20 mm, 23 mm, 26, and 29 mm are shown by tab shapes 502, 506, 510 and 514 having lifting tabs 504, 508, 512, and 516 respectively.

As shown as tab shapes 502, 506, 510 and 514, as the tab depth is increased and the tab size approach the tab depth, the resealable tab is generally annular or circular shape.

However, when the tab depth is increased to 30 mm, the tab shapes shown 602, 606, 610 and 614 are more oval shaped at tab sizes 20 mm and 23 mm, but become more annular shaped as shown by tab shapes 610 and 612. Resealable tab 614 is generally circular shaped. Each of the tab shapes 602, 606, 610 and 614 have a lifting member depicted in dashed members 604, 608, 612 and 616, respectively. As depicted in lifting member 604, the lifting tab can extend to be a significantly extended protruding lifting member. In the alternative, the lifting member can be a thin elongated member as depicted by lifting tab 616.

It is envisioned that the teaching of this invention could be used for a lid to be applied to a container, for any beverage, liquid or the lid where the lid has an orifice, opening or aperture that could be used as an access opening, pouring opening, drinking opening, straw passage opening or the like when the lid is operatively attached to a container. The orifice, opening or aperture in the lid can be resealed using the resealable tab of the present invention.

The fluid, beverage or the like placed in a container having a lid and drinking opening closed or sealed using the resealable tab of the present invention may be hot or cold fluid or liquid. It is envisioned that a variety or known food grade adhesives could be used in practicing this invention depending on the application.

The thickness of the adhesive layer may preferably be selected to vary from about 0.001 inch to about 0.010 inch. In certain applications where a strong bonding is required, the thickness may be greater than about 0.010 inch. In certain applications the thickness may be less than about 0.001 inch depending on the requirements, such as dimension and shape of the opening. The adhesive layer must be of a sufficient or minimum thickness to not be opened or unsealed by the force of the fluid spouting through the sealed opening. If the adhesive layer is too thick, the tab may be to high off of the drinking opening, which is undesirable.

Also, if a more aggressive adhesive is required, the surface area of the adhesive seeking area can be increased. Generally, this would require the use of the tab having a greater surface area for engaging and sealing with the top surface.

It is envisioned that all variations of the resealable tab shapes, size, adhesives, thickness of the adhesive sealing layer and opening size can be accommodated using the teachings of this invention.

What is claimed is:

1. A lid for a drinking cup and a resealable tab comprising, a drinking opening formed in a top surface of the lid; and a relatively thin, flexible substrate formed as the resealable tab, having a first surface and second surface, said substrate having a shape and dimension which is adapted to cover said drinking opening with either one of said first surface and second surface; and a food grade adhesive located between one of said first surface and second surface and a top surface of the lid to enable one of said first surface and second surface to be located over said drinking opening wherein said adhesive forms a sealing layer of a predetermined thickness between that portion of the top surface defining said drinking opening and said one of said first surface and second surface, the spacing therebetween being determined by the thickness of said adhesive sealing layer, wherein the substrate material, and thickness and composition of the sealing layer of food grade adhesive, are further adapted for sufficient flexibility and suitable adhesion to;

allow for the tab to fold over and seal over an edge of the drinking opening in a manner adequate to prevent spillage.

2. The resealable tab of claim 1 wherein said food grade adhesive further comprises a composition which has increased adhesivity as the temperature thereof is increased above ambient temperature.

3. The resealable tab for a drinking cup lid of claim 1 wherein said adhesive is coated on one of said first surface and second surface and said one of said first surface and second surface is affixed to the drinking opening.

4. The resealable tab of claim 1 wherein said adhesive is coated on said top surface and said one of the first surface and second surface is affixed to the adhesive coated on that portion of the top surface surrounding the drinking opening.

5. The resealable tab of claim 1 wherein said substrate is generally oval in shape.

6. The resealable tab of claim 1 wherein substrate is generally circular in shape.

7. The resealable tab of claim 1 wherein said substrate has a lifting member.

8. A method for preventing spilling of a fluid from a drinking cup lid having a top surface defining a drinking opening comprising the step of: affixing a resealable tab which is configured to cover said drinking opening wherein said resealable tab has a relatively thin, flexible substrate and a first surface and a second surface wherein said substrate has a shape and dimension to cover said drinking opening with either one of said first surface and second surface, and wherein at least one of said first surface, said second surface and said top surface has a food grade adhesive located thereon to enable said adhesive to form a sealing relationship between that portion of the top surface defining said drinking opening and at least one of said first surface and second surface by folding the tab over at least one edge of the drinking opening.

9. The method of claim 8 wherein the step of affixing includes a resealable tab having said adhesive located on at least one of said first surface and said second surface which forms a sealing relationship with the top surface defining the periphery of said drinking opening.

10. The method of claim 8 wherein the step of affixing includes a food grade adhesive comprising a composition which has increased adhesivity as the temperature thereof is increased above ambient temperature.

11. The method of claim 8 wherein the affixing step includes sealing the tab over a lid opening which can be wet due to factors including a drinking step by a user of the drinking cup and spillage from the drinking opening before or during a period when the tab is covering the opening.

12. The method of claim 8 further comprising affixing the tab to a part of the lid for storage when the tab is not being used to seal the drinking opening.

* * * * *